US010274291B2

(12) United States Patent
Davis et al.

(10) Patent No.: US 10,274,291 B2
(45) Date of Patent: Apr. 30, 2019

(54) LUMINESCENT ARCHERY TARGET

(71) Applicants: Seth Jeremiah Davis, Chatsworth, GA (US); Herman Ray Davis, Chatsworth, GA (US)

(72) Inventors: Seth Jeremiah Davis, Chatsworth, GA (US); Herman Ray Davis, Chatsworth, GA (US)

(73) Assignee: KRYPTOLIGHT TARGETS LLC, Chatsworth, GA (US)

( * ) Notice: Subject to any disclaimer, the term of this patent is extended or adjusted under 35 U.S.C. 154(b) by 64 days.

(21) Appl. No.: 15/058,781

(22) Filed: Mar. 2, 2016

(65) Prior Publication Data

US 2016/0258721 A1 Sep. 8, 2016

Related U.S. Application Data

(60) Provisional application No. 62/127,961, filed on Mar. 4, 2015.

(51) Int. Cl.

| | |
|---|---|
| ***F41J 1/01*** | (2006.01) |
| ***F41J 3/00*** | (2006.01) |
| ***F41J 2/00*** | (2006.01) |

(52) U.S. Cl.

CPC ..... *F41J 3/0004* (2013.01); *F41J 1/01* (2013.01); *F41J 2/00* (2013.01)

(58) Field of Classification Search

CPC ..... F41J 3/0004; F41J 1/01; F41J 2/00; F41J 1/00; F41J 3/00; F21V 1/17; F21V 3/08; F21V 3/12; F21V 5/10; F21V 7/26; F21V 7/30; F21V 9/30; F21V 9/32; F21V 9/45

See application file for complete search history.

(56) References Cited

U.S. PATENT DOCUMENTS

| | | | | |
|---|---|---|---|---|
| 2,568,279 A * | 9/1951 | Walkup | F21V 9/16 250/459.1 |
| 3,445,551 A | 5/1969 | Griffin | |
| 3,565,815 A | 2/1971 | Christy | |
| 4,203,600 A * | 5/1980 | Brown | F41J 1/00 273/407 |
| 4,392,652 A | 7/1983 | Knight et al. | |
| 4,736,955 A | 4/1988 | Pollock | |
| 4,850,596 A * | 7/1989 | Olund | F41J 1/01 273/408 |
| 5,321,069 A | 6/1994 | Owens | |
| 5,580,063 A * | 12/1996 | Edwards | F41J 1/01 273/378 |
| 5,865,440 A | 2/1999 | Pulkrabek | |

(Continued)

OTHER PUBLICATIONS

Flex Fletch Products, Glow in the Dark Targets; http://flex-fletch.ecrater.com; Jan. 16, 2015.

*Primary Examiner* — Bao Q Truong
(74) *Attorney, Agent, or Firm* — Robinson IP Law, PLLC

(57) ABSTRACT

A luminescent archery target enabling target shooting in low light conditions. At least a portion of the target is formed from a material that glows in the dark for long durations, such as a strontium-based luminescent composition. Example target configurations include a non-luminescent core and an outer layer applied over at least a portion of the core, wherein the outer layer includes the luminescent material. The target can be configured as a three-dimensional block, as a model of a game animal, or in other shapes and sizes.

25 Claims, 5 Drawing Sheets

(56) References Cited

U.S. PATENT DOCUMENTS

| | | | | |
|---|---|---|---|---|
| 6,247,700 | B1 * | 6/2001 | Procupetz | F41J 1/01 273/348 |
| 6,799,764 | B2 | 10/2004 | Ingold | |
| 8,333,385 | B2 * | 12/2012 | McGovern | F41J 3/0004 273/403 |
| 8,366,573 | B2 | 2/2013 | Hunt | |
| 9,170,077 | B2 | 10/2015 | Johnson et al. | |
| 2005/0160637 | A1 * | 7/2005 | Hesse | E04H 13/003 40/124.5 |
| 2007/0261151 | A1 | 11/2007 | Padgett et al. | |
| 2012/0200041 | A1 | 8/2012 | Simmons | |
| 2013/0270772 | A1 | 10/2013 | McGovern | |
| 2014/0054501 | A1 | 2/2014 | Rogers et al. | |

* cited by examiner

LUMINESCENT ARCHERY TARGET

CROSS-REFERENCE TO RELATED APPLICATION

This application claims the priority benefit of U.S. Provisional Patent Application Ser. No. 62/127,961 filed Mar. 4, 2015, the entirety of which is hereby incorporated herein by reference for all purposes.

TECHNICAL FIELD

The present invention relates generally to the field of targets, and more particularly to a luminescent or glow-in-the-dark archery target suited for use in low-light conditions, including no-light conditions and in total darkness.

BACKGROUND

Archers and bow-hunters often practice their accuracy and skills by shooting arrows at targets, for example, using a bow or cross-bow. Targets of various forms are known, for example, taking the form of concentric circle "bulls-eye" targets, three-dimensional rectangular blocks, and/or simulated game animals and the like.

Previously known archery targets are not well suited to use in low-light conditions, due to limited visibility. This can limit the time available for archers to practice their skills to daylight hours or where lighted shooting facilities are available. Even during daylight hours, overcast conditions, deep shade and dawn or dusk twilight conditions may present less than optimal target visibility. Presently, any archer who wishes to practice at night must place their target under a street light, flood light, etc. in order to be able to see their target. Many archers would prefer to extend the available practice time to further their skills, but lack the ability or resources to do so using previously known target equipment.

There are no known archery targets with luminescence. Many previously known technologies for imparting luminescence to other types of objects are limited in their effectiveness for various reasons, and may be particularly unsuited for adaptation to use in archery targets. For example, many luminescent materials and products lack sufficient durability, do not provide adequate luminescence for low-light target shooting, and/or do not provide suitable luminescence for a sufficiently long period of time. Many previously known materials used for luminescent products also are prone to damage from ultraviolet (UV) light if left in the sun for extended periods, or otherwise deteriorate upon prolonged exposure to the weather, as is commonly encountered in use of archery targets.

It is to the provision of an improved archery target that may be used in low-light conditions that the present invention is primarily directed.

SUMMARY

The present invention is generally directed to the field of targets, for example targets for archery and other shooting or throwing sports. More particularly, example embodiments of the invention relate to luminescent or glow-in-the-dark archery targets suited for use in low-light conditions (including no-light conditions such as in total darkness at night, without the need for artificial outdoor lighting such as truck headlights, street lights or flood lights), providing durability to impact and penetration by arrows and other projectiles, long-duration strong luminescence, and resistance to deterioration from exposure to UV light (such as from sunlight or other light used to "charge" the luminescent material of the target) and other weather elements targets used outdoors are likely to be exposed to. The target of the present invention eliminates the need for outdoor lighting for target shooting. The target can be placed anywhere that outdoor lighting is either not convenient or not available, in total darkness, and still be highly visible in order to provide shooting opportunities at night. Example embodiments of the invention also relate to efficient manufacturing processes for producing such targets.

In one aspect, the invention relates to a luminescent target including a target core, and a luminous outer layer covering at least a portion of the target core. Optionally, the target is an archery target in the form of a three-dimensional block, a model of a game animal, or other target configuration, and comprises an arrow-stopping material having resilient or self-healing properties.

In another aspect, the present invention relates to a method of manufacturing a luminescent target including mixing a polyisocyanate material with polyol to form a liquid polyurethane mixture; injecting the liquid polyurethane mixture within a cavity of a mold, the cavity of the mold comprising at least a first portion that is generally movable relative to at least a second portion; moving the first portion relative to the second portion such that the size of the cavity increases whereby a void is formed between the injected polyurethane mixture and the first portion; mixing a luminous pigment with polyol to form a glow mixture; mixing the glow mixture with the polyisocyanate material to form a liquid polyurethane glow mixture; and injecting the liquid polyurethane glow mixture into the mold such that the liquid polyurethane glow mixture fills the void formed between the injected polyurethane mixture and the first portion.

In another aspect, the present invention relates to a method of manufacturing a luminescent target including mixing a polyisocyanate material with polyol to form a liquid polyurethane mixture; pouring the liquid polyurethane mixture within a cavity of a mold to form a core of the luminescent target, the mold comprising at least one side with a recessed area sufficient to create at least one cavity in the corresponding side of the core; creating at least one sheet of luminescent material approximately the same size and shape as the at least one cavity in the core of the luminescent target; and permanently attaching the at least one sheet of luminescent material into the at least one cavity in the core of the luminescent target.

In another aspect, the invention relates to an archery target including a polyurethane base material and a strontium-based luminescent material, whereby the archery target resists destruction from repeated penetration by archery arrows, and whereby the archery target glows sufficiently for target shooting in low light conditions where a non-luminescent target would not be sufficiently visible for safe use.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 2:
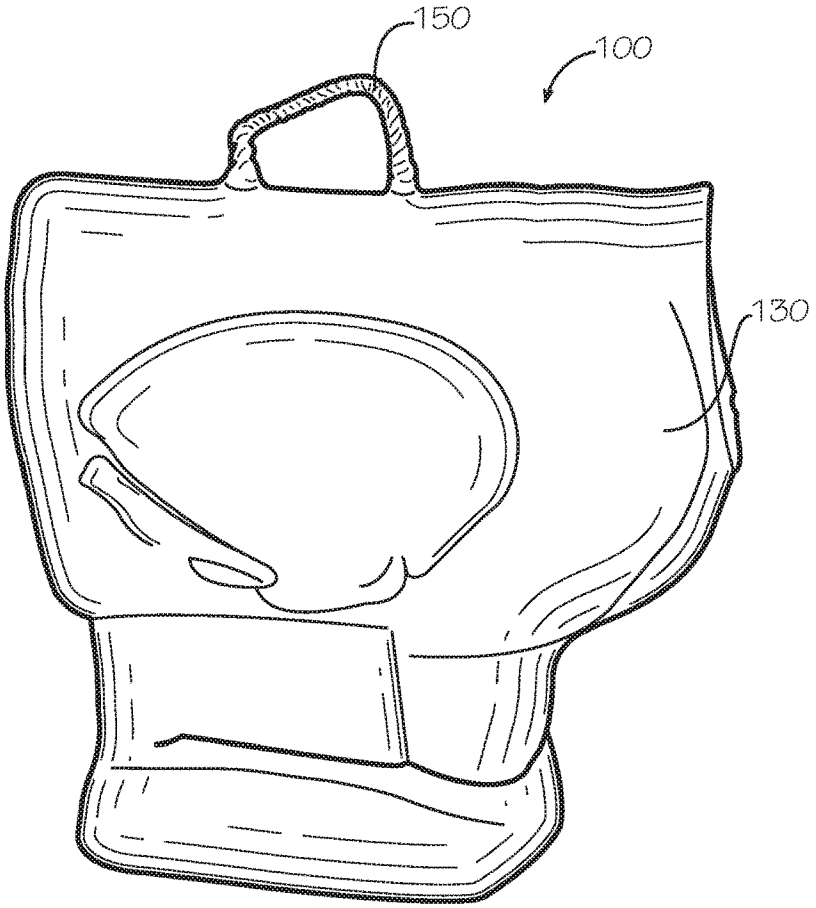
FIG. 2 is a perspective view of a luminescent archery target according to another example embodiment of the present invention.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-4 show luminescent archery targets according to example embodiments of the present invention. In example forms, the targets 10, 100, 200, 300 are preferably at least partially formed from a luminous or luminescent material or pigment such that at least a portion of the target 10, 100, 200, 300 is luminescent (self-lighting) or glows in the dark, and which is self-charging by exposure to daylight or sunlight, or to light from other light sources. In example embodiments, the targets are well suited for use in low-light conditions, provide durability to impact and penetration by arrows and other projectiles, have long-duration strong luminescence, and resist deterioration from exposure to UV light and other weather elements. As used herein, the term "low-light conditions" includes no-light conditions, such as at night, in total darkness, as well as twilight, dusk, early morning, moonlight or other indoor or outdoor conditions where lighting is insufficient for target shooting using non-luminescent targets.

Figure 1:
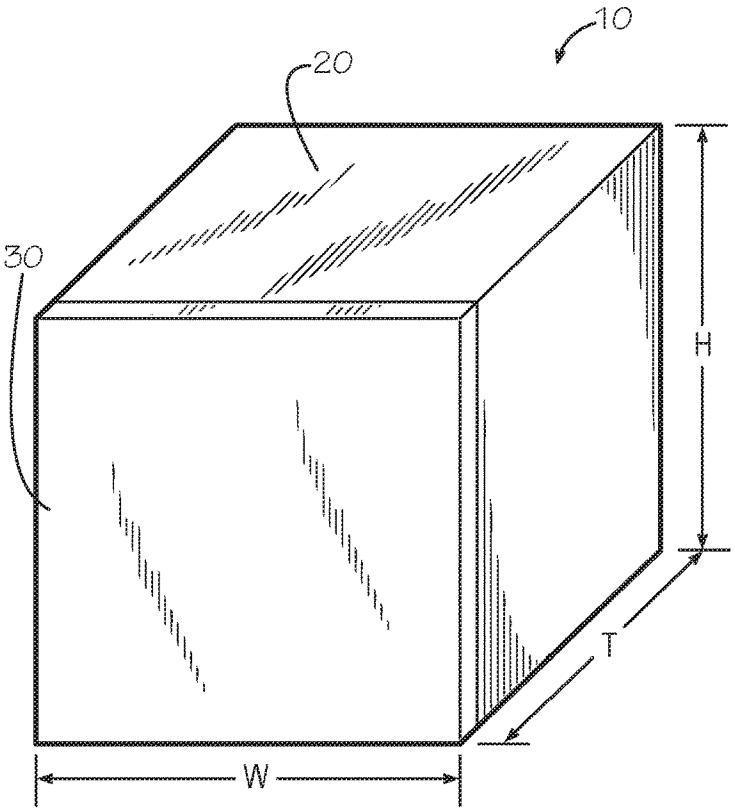
FIG. 1 is a perspective view of a luminescent archery target according to an example embodiment of the present invention.

FIG. 1 shows a luminescent archery target 10 according to one example form of the invention. As shown, the target 10 is generally three-dimensional block-shaped (i.e., a rectangular or cubic three-dimensional prismatic body) and comprises 6 sides, namely, a top, a bottom, left and right sides, a front and a back. In example forms, the target 10 generally comprises a main body portion or core 20 and at least one outer "glow" surface or layer 30 formed on at least one of the sides of the core 20. Optionally, the outer layer 30 may be formed on at least a portion of one or more of the sides of the core 20. As depicted in FIG. 1, the outer layer 30 is formed on the front side of the target 10. Optionally, two or more outer surface portions of the target 10 can comprise the luminescent outer "glow" layer 30, or an inner core can be surrounded on all sides by a luminescent outer cladding or outer layer. In other forms, the luminescent layer 30 is applied to the front and back of the core 20. In alternate embodiments, all or any portion of the target 10 can comprise the luminescent material or composition. For example, in alternate forms, the target 10 can comprise a luminescent inner core 20, and a non-luminescent transparent or translucent outer protective layer or coating 30. Optionally, non-luminescent material may be attached over the luminescent outer layer 30 to create a design, for example the traditional concentric circle "bulls-eye" design, or for improved durability or other purposes. In further embodiments, the target is made entirely of glow foam throughout the whole target.

According to example forms, the archery target 10 comprises a width W, a height H, and a depth or thickness T. According to example forms, the height H and width W are between about 1-10 feet and the thickness T is between about 3-36 inches. According to further example forms, the height H and the width W are about 3 feet and the thickness is about 16 inches. In example forms, the thickness of the outer layer 30 is generally between about 0.03125 (1/32") inches and about 6 inches, but may be thinner or thicker depending on the particular embodiment and intended application. According to additional example forms, the archery target 10 can be shaped in the form of a cylinder comprising a diameter of between about 1-10 feet and a height of between about 3-60 inches. According to further example forms of the cylindrical target, the diameter is about 3 feet and the thickness is about 16 inches. Optionally, as will be described below, the luminescent archery target 10 can be shaped according to various three-dimensional game animal formats, for example having the shape and size of a typical deer, bear, turkey, elk, coyote, boar, or other game animal.

In example embodiments, the core 20 is formed of foam material. In example forms, the core 20 comprises a polyurethane foam material comprising a mixture of polyisocyanate material and polyol. Optionally, the foam material may comprise a UV stabilizer to improve the durability of the foam and reduce surface degradation. A non-exhaustive list of applicable UV stabilizers includes benzophenones, benzotriazoles, oxanilides, hydroxyphenyltriazines, hydroxybenzophenone, hydroxyphenylbenzotriazole, hydroxyphenyl triazines and hindered amine light stabilizers. In example embodiments, the concentration of UV stabilizers in the foam material is between around 0.05% and around 5%. Depending on the intended usage of the target, in example embodiments the core 20 is formed of one or more materials having sufficient durability and resistance to damage from repeated impact or penetration by archery arrows or other projectiles, and optionally comprises some measure of resilience and/or self-healing characteristics.

Preferably, at least a portion of the archery target 10 comprises a phosphorescent or photoluminescent outer "glow" layer 30. In example forms, the phosphorescent or photoluminescent outer layer 30 comprises a strontium-based luminescent material or pigmented composition, for example, which allows for the absorption and release of light photons, thereby being luminescent such that the archery target self-charges upon exposure to light (e.g., sunlight or other light source) and will glow or generally release light over a long period of time with sufficient luminescence suitable for target shooting activities in low-light conditions. Optionally, the outer layer 30 may comprise other pigments, additives, or concentrates comprising similar luminous characteristics. In example forms, the pigment comprises strontium aluminate ($SrAl_2O_4$). In further example forms, the strontium aluminate pigment is in the form of a LumiNova® strontium aluminate pigment powder. Optionally, the strontium aluminate pigment may take other forms in addition to powder, for example, granules, pellets, liquid concentrate, or other compositional forms, for example incorporated into or onto the material of the luminescent layer of the target. Optionally, other pigments comprising strontium aluminate, strontium, phosphoric elements, other minerals, or other elements or combinations thereof may be incorporated into the target. Optionally, the phosphorescent or photoluminescent material or pigment may be applied to the core in the form of a cover material or a coating.

In example forms, the portion(s) of the target 10 with the phosphorescent or photoluminescent material or pigment, for example, the outer layer 30, will begin to absorb light or "charge" the moment it is exposed to sunlight or any other light, and will recharge numerous times over the intended product lifecycle. Typically, the outer layer 30 produces an afterglow period of visible illumination of up to about 10 times that of zinc sulfide (ZnS) based phosphorescent pigments (e.g., up to about 12 hours of glow time). Generally, the outer layer 30 can be activated by a wide range of wavelength bands of light (between about 200-450 nm). Preferably, the outer layer 30 can recharge an infinite or very high number of times, for example, wherein after the 12 hour glow period, further exposure to light permits the absorption of light energy, which is subsequently released in later use. Preferably, the luminescent target 10 does not require significant maintenance and can be left outdoors in the weather, and the glow properties will not go away, wear off, wash off or weather away, at least during the expected life cycle of the target. In other example forms, the phosphorescent or photoluminescent pigment, material or coating is capable of visibly glowing for shorter or longer duration, depending on the particular embodiment and intended application.

FIG. 2 shows a luminescent archery target 100 with an external shape in the form of a deer shoulder area or torso. As shown, all or a substantial amount of the front side of the target 100 comprises the luminescent outer layer 130, surrounding an inner core. Alternatively, both sides or the entire exterior of the target 100 comprise a luminescent outer layer 130. In example embodiments, the materials of construction of the target 100 are substantially as described above for target 10. Optionally, a transparent or translucent outer protective layer can be provided over the luminescent material 130, allowing external visibility of light from the luminescent material and providing additional resistance to damage or deterioration of the target. In example forms, the base of the target 100 may be substantially wide or comprise a sufficient area such that the target 100 can stand upright without tipping over, especially during the period in which one or more arrows or other projectiles impact the target 100. Optionally, one or more base anchors can be provided for additional stability. In example embodiments, a carrying handle 150 of rope or other material is coupled to an upper portion of the target 100 (or portions thereof molded therein) such that a user can easily carry the target 100 with one or both hands.

Figure 3:
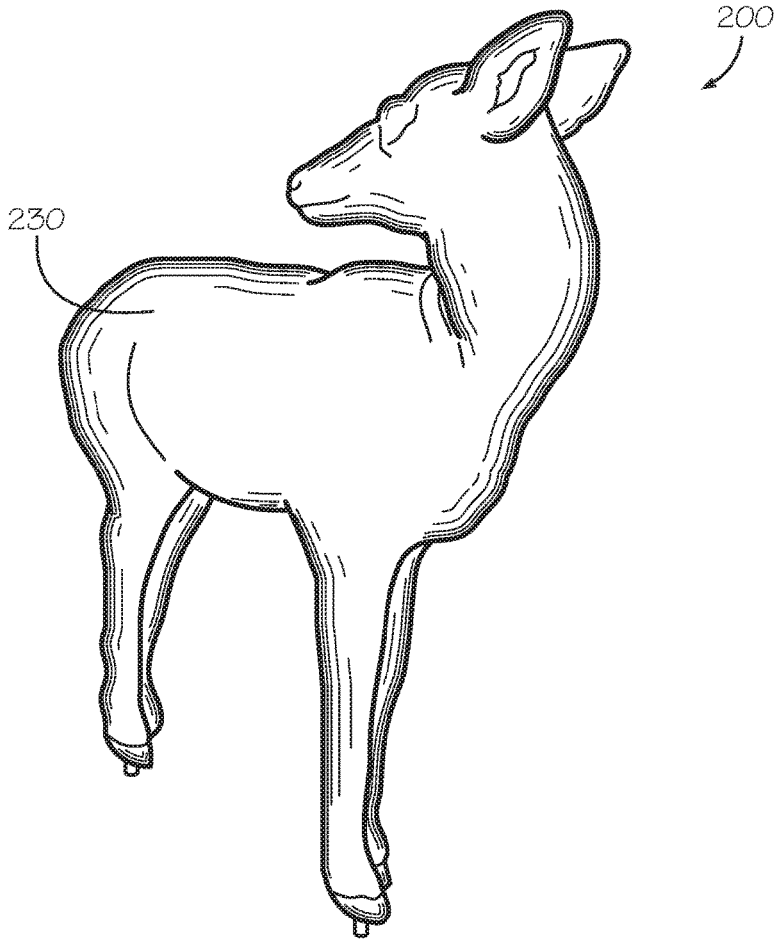
FIG. 3 is a perspective view of a luminescent archery target according to another example embodiment of the present invention.
Figure 4:
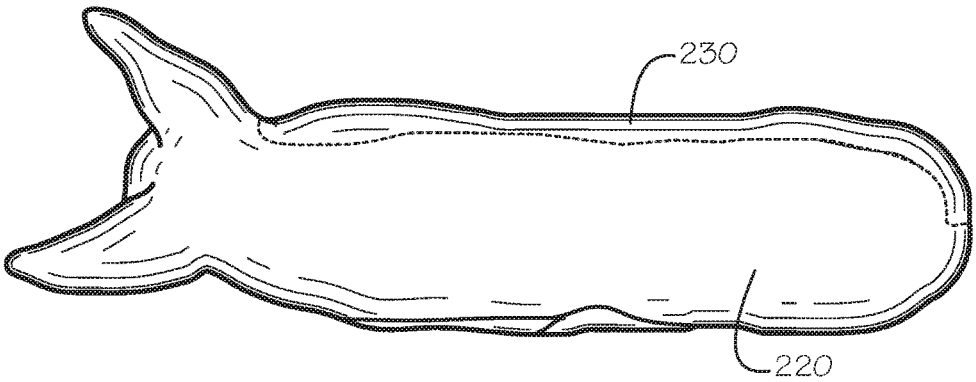
FIG. 4 is a top view of the luminescent archery target of FIG. 3.

FIGS. 3 and 4 show a luminescent archery target 200 according to another example embodiment of the present invention. As shown, the target 200 is generally in the form of a life-size model of a whitetail deer. As shown in FIG. 4, at least a portion of the front side of the target 200 comprises a luminescent outer layer 230 and the rest of the target 200 comprises a core 220. In example embodiments, the materials of construction of the target 200 are substantially as described above for target 10.

In further embodiments, the invention relates to a method of use of a luminescent archery target, for example a target according to one or more of the example embodiments described. The method comprises providing a luminescent archery target, exposing the luminescent archery target to light energy at an activating wavelength to charge the luminescent archery target with light energy for a sufficient period of time to cause the luminescent archery target to self-illuminate or glow. The method further comprises placing the charged luminescent target at a target site selected for safety and visibility, for example in an area clear of humans, animals or other objects. The method further comprises aiming a projectile such as an arrow at the luminescent archery target, and shooting the arrow at the target using a bow or crossbow. Optionally, the method further comprises withdrawing the arrow from the target for reuse, and repeating the target shooting sequence. Optionally, the material(s) of composition of the luminescent archery target 10 are at least partially resilient and self-healing, to resist destruction of the target by repeated shooting and impact.

In additional example embodiments, the present invention relates to a method of manufacturing a luminescent target 300, depicted in FIGS. 5-9. In example embodiments, the method comprises mixing a polyisocyanate material with polyol to form a liquid polyurethane mixture 322, pouring the liquid polyurethane mixture 322 into the cavity of a mold 360, the mold 360 comprising at least one side with a mold insert or inwardly projecting mold portion 362 that creates a cavity 324 on the surface of the molded target core 320 formed in the mold; closing the mold 360 and allowing the liquid polyurethane mixture 322 to react, expand and become solid creating the target core 320; and attaching a glow insert 332 in the cavity 324 in at least one side of the target core 320 created by the mold insert 362 in at least one side of the mold 360.

Figure 5:
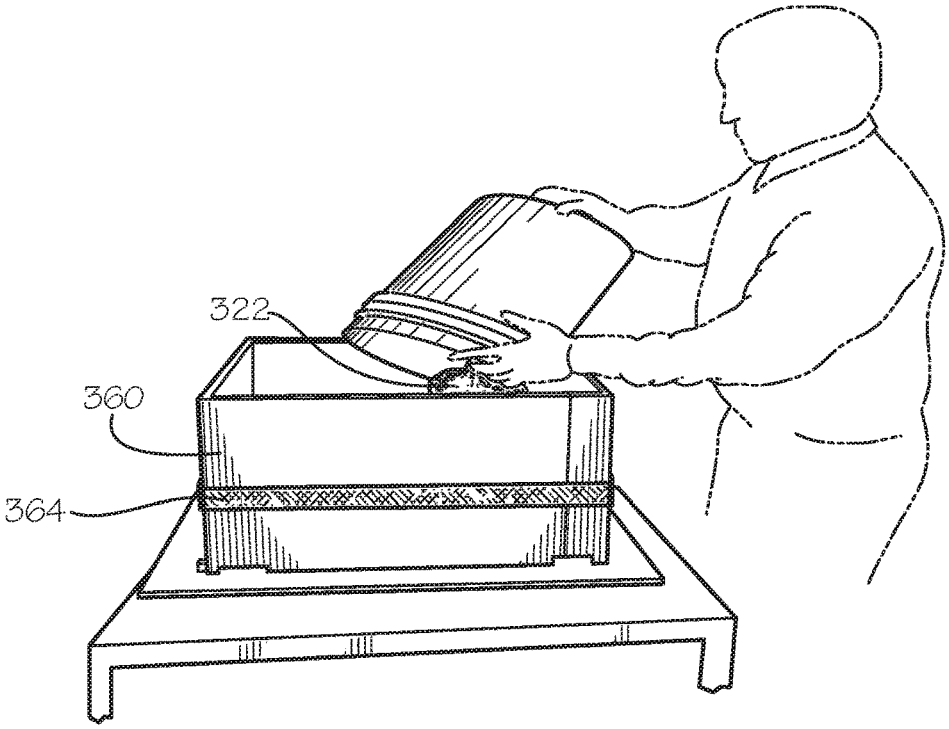
FIGS. 5-9 show a sequence of steps in a process for manufacturing a luminescent archery target according to an example embodiment of the invention.
Figure 6:
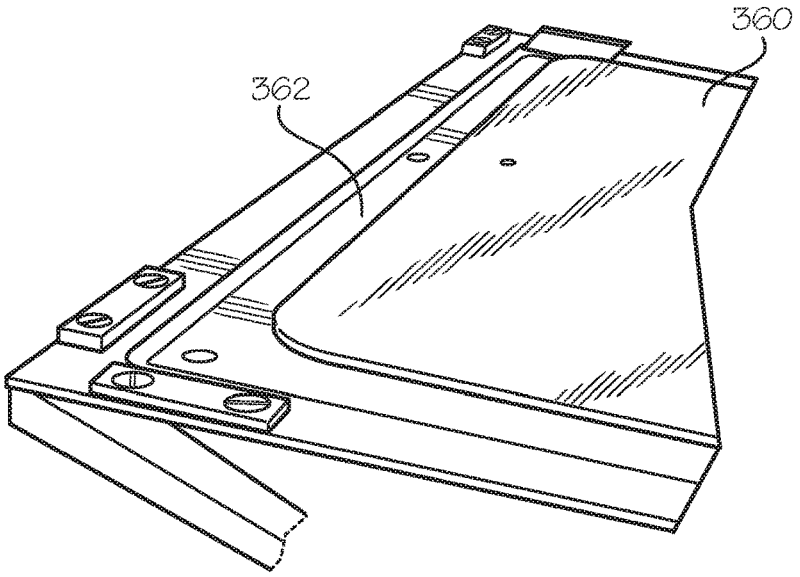
Figure 7:
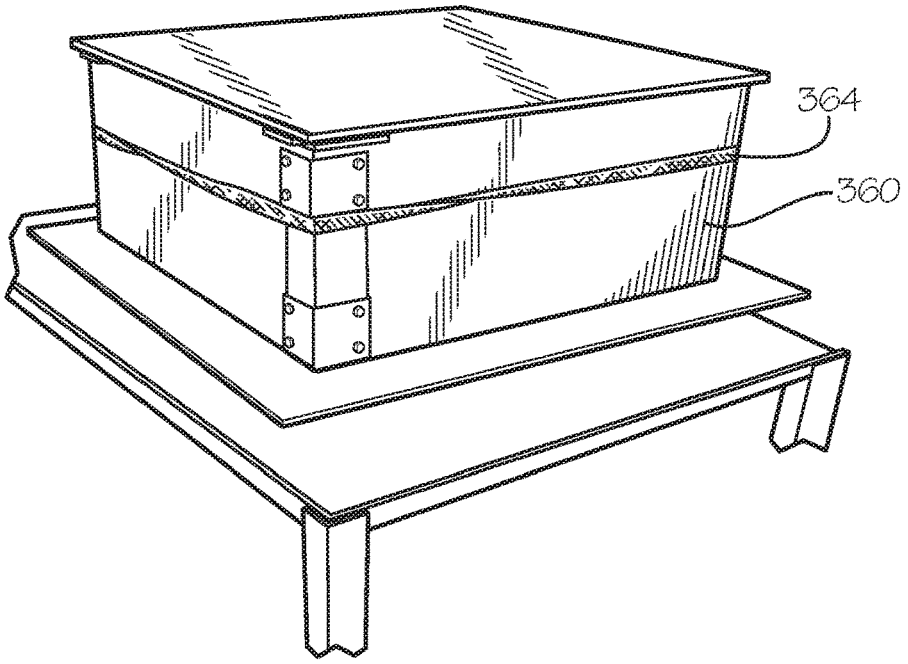

In example embodiments of the manufacturing process, an industrial mixer is used to compound a polyisocyanate material with polyol to form a "plain" (non-luminescent) liquid polyurethane foam 322. The quantities of the polyisocyanate material and polyol materials may vary by selective control of the constituents, for example, such that the density of the resulting liquid foam 322 is between about 2-16 pounds per cubic foot. As depicted in FIG. 5, the liquid polyurethane foam 322 is delivered into a mold 360 to form the core 320 of the target. The material can be delivered to the mold manually as shown, or alternatively in automated fashion. The mold 360 can be formed from detachable sides configured to form the shape and size of the desired target 300. In example form, the mold 360 comprises six flat sides, removably coupled to form a rectangular cavity. Optionally, a removable or detachable belt or elastic band 364 may be fitted around a plurality of the sides of the mold to reinforce the sides and retain them in place while the polyurethane liquid foam reacts and expands to fill the mold and form the core of the target. The mold 360 optionally includes at least one side with a mold insert 362 projecting inwardly from the mold surface, as depicted in FIG. 6. This mold insert 362 or surface projection into the mold forms a cavity 324 in the corresponding surface of the target core 320. In example embodiments, the cavity 324 is between about 1/32" and about 6" deep. In example embodiments, the mold insert 362 is designed to create a rectangular cavity 324 in the formed core; however the recess 362 and cavity 324 can be configured in various alternate shapes or sizes depending on the intended use of the target 300. After the liquid polyurethane foam 322 is poured into the cavity of the mold 360, the mold 360 is closed as depicted in FIG. 7. The liquid foam 322 is allowed to react, rise and fill the form of the mold 360. In the example embodiment this process takes approximately 10 minutes.

Figure 8:
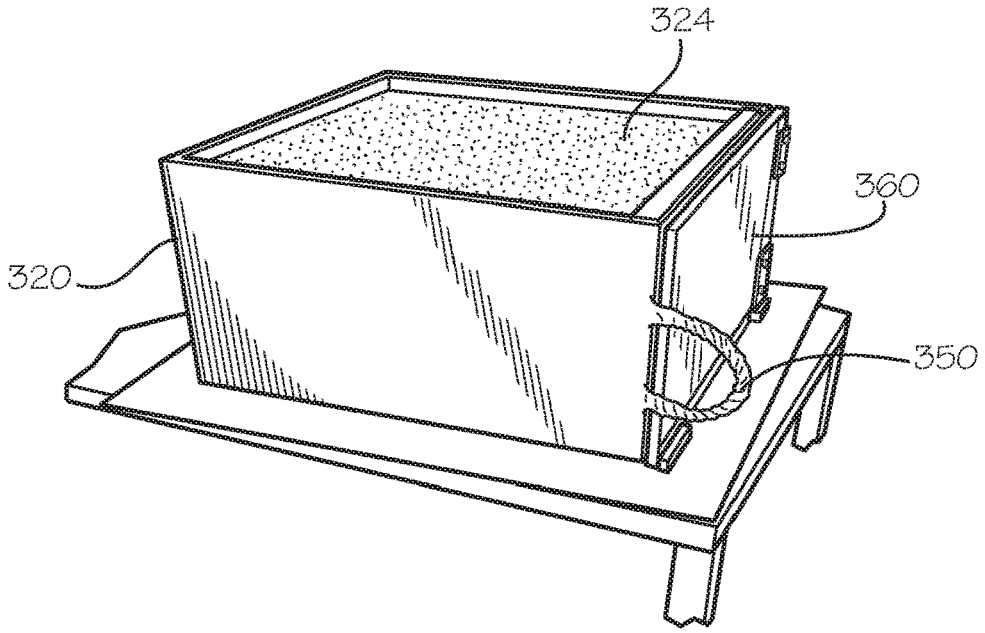

When the liquid polyurethane foam 322 has cured and reached a solid state, the core 320 is removed from the mold 360. This may be accomplished by decoupling the detachable sides of the mold 360 by removing the belt or band 364, as depicted in FIG. 8, until the core 320 may be extracted from the mold 360. Optionally one or more handles 350 may be permanently attached to the target core 320, for example by molding the handles into the core or attaching them to the core with adhesive, screws or other fasteners.

Figure 9:
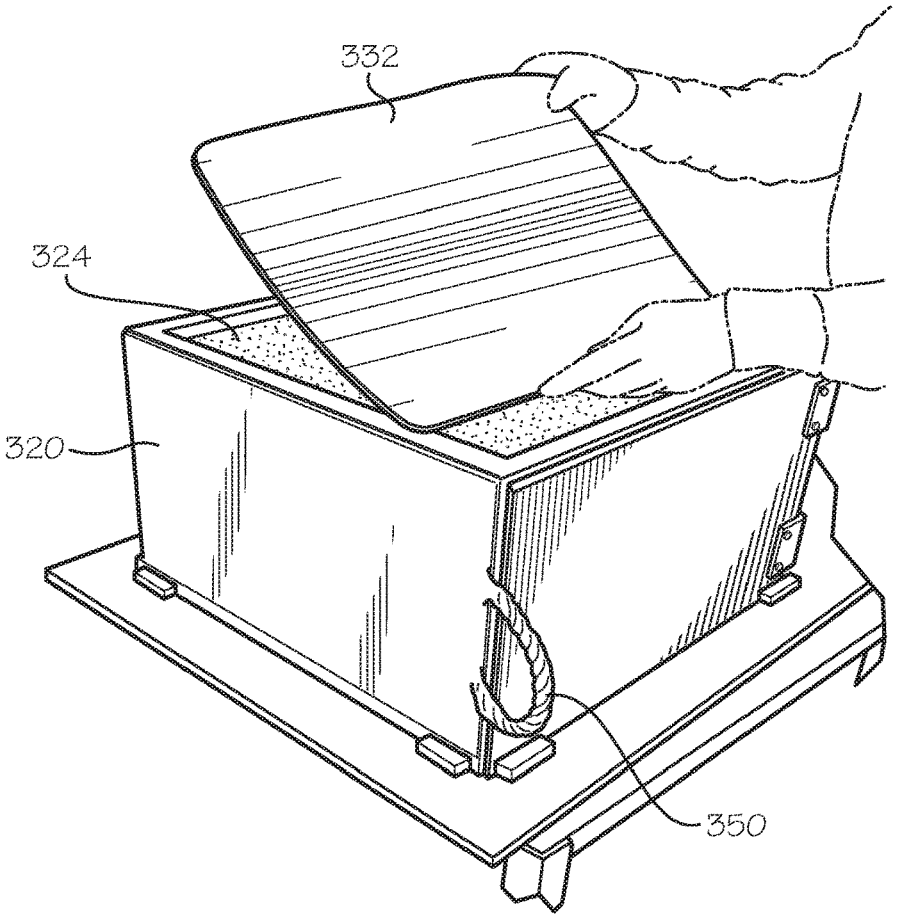
Figure 10:
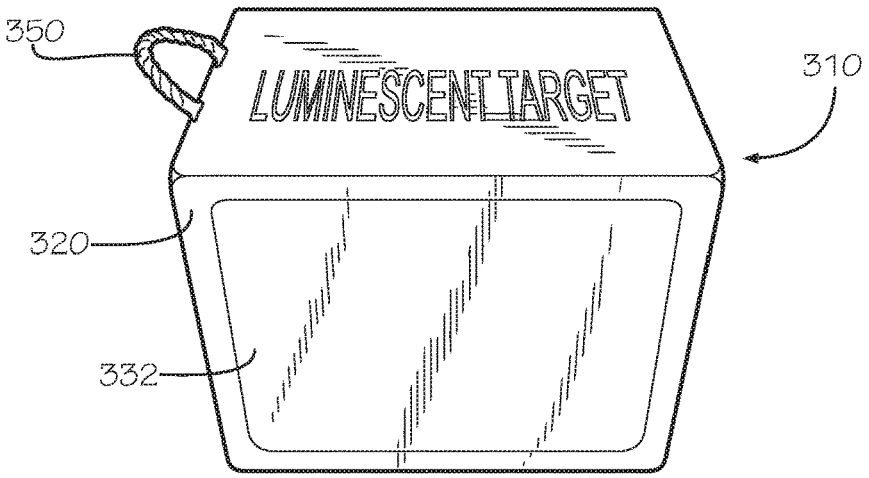
FIG. 10 is a perspective view of a luminescent archery target according to another example embodiment of the present invention, formed by the manufacturing process of FIGS. 5-9

The material used to form the glow sheet or insert 332 is then compounded or mixed together. In example form, a phosphorescent strontium pigment is mixed with polyol in ratios from between about 5-50% by weight to form a "glow mixture." The glow mixture is then again compounded or mixed with polyisocyanate to form a liquid polyurethane glow mixture. The liquid polyurethane glow mixture is then formed into a glow foam sheet 332 which is shaped or cut to fit the cavity 324 in the one or more sides of the target core 320. In example form, the glow foam sheet 332 is about the same thickness as the depth of the cavity 324. Then, as depicted in FIG. 9, the glow foam sheet 332 is inserted and permanently attached to the core 320 inside the cavity 324, for example by a polyurethane based adhesive, glue or fasteners. In alternate embodiments, the mold insert 362 is omitted, and a sheet of glow material 332 is attached to an exterior surface of the target core 320 in like manner. In further alternate embodiments, the glow material is co-molded with the core material, or the entire target is formed of the glow material.

Optionally, one or more UV stabilizer materials as described above may be added to the polyurethane foam of the core 320 and/or the glow insert 332. At least one UV stabilizer may be mixed into the liquid polyurethane foam 322 before it is poured into the mold 360. Alternatively, after the target 300 is formed, it may be treated with a solution comprising a solvent and at least one UV stabilizer, or may be coated or covered with a UV-resistant and/or water-resistant coating or cladding for resistance to deterioration from exposure to sunlight or other weather element.

In additional example embodiments, the present invention relates to method of manufacturing a luminescent target 10 comprising: injecting a liquid polyurethane mixture 322 within a cavity of a mold 360, the cavity of the mold 360 comprising at least a first portion that is generally movable relative to at least a second portion; moving the first portion relative to the second portion such that the size of the cavity increases whereby a void is formed between the injected polyurethane mixture 322 and the first portion; and injecting a liquid polyurethane glow mixture into the mold such that the liquid polyurethane glow mixture fills the void formed between the injected polyurethane mixture 322 and the first portion.

In another example method of manufacture of a luminescent target according to the present invention, liquid polyurethane foam precursor material is mixed as described above. The material is then injected or deposited into a mold to form the core. As described above, the mold can be shaped and sized as desired to form the desired core configuration. The mold preferably comprises at least one movable wall or portion thereof such that the outer luminescent layer (as will be described below) can be over-molded onto the core. Optionally, other molding techniques or other manufacturing methods may be used to form the core and/or luminescent outer layer to form the target. For example, the entire target can comprise the luminescent material.

After the liquid polyurethane foam has dried within the mold, forming the core, the at least one wall or a portion of the mold is generally moved outwardly away from the core to form a space or void between a portion of the mold and the core. According to one example form, the entire front wall of the mold is moved away from the core between about 1/32" and about 6". The material to be provided for forming the luminescent outer layer is then compounded or mixed together to form a liquid polyurethane glow mixture as described above. The liquid polyurethane glow mixture is then injected into the mold to fill the void that was created by moving the walls or other portion of the mold out, away from the formed core. As such, the liquid polyurethane glow mixture is over-molded onto at least a portion of the core, thereby forming a luminescent archery target having a regular (i.e., non-luminescent) polyurethane foam core and an outer luminescent layer that is made of glowing polyurethane or other material, for example comprising a mixture of polyurethane foam and the phosphorescent strontium pigment. In example forms, the foam core is generally allowed to at least partially dry prior to injecting the liquid foam with glow properties within the mold. Preferably, the foam with glow properties substantially adheres to the foam core albeit the foam core being at least partially dry. Optionally, the foam core is allowed to fully dry prior to injecting the liquid polyurethane glow mixture within the mold.

Optionally, the mold comprises a core comprising one or more projections such that when forming the core, one or more voids are formed within the core and extend to an outer surface of the core. As such, the liquid polyurethane glow mixture may be injected only within the one or more voids formed by the core, rather than the entire side of the target before formed from the polyurethane glow mixture, e.g., the outer layer.

While the invention has been described with reference to preferred and example embodiments, it will be understood by those skilled in the art that a variety of modifications, additions and deletions are within the scope of the invention, as defined by the following claims.

What is claimed is:

1. A luminescent target comprising:

a target core including a cavity; and a molded sheet located in the cavity and formed from luminescent material overlying at least a portion of the target core wherein the luminescent material is self-charging by exposure to light;

wherein the luminescent target is sufficiently durable to withstand repeated impacts and penetrations by projectiles and is at least partially resilient, and wherein the luminescent target provides sufficient luminescence for target shooting in low-light conditions.

2. The luminescent target of claim 1, wherein the target is an archery target.

3. The luminescent target of claim 1, wherein the luminescent material comprises a strontium-based luminescent composition.

4. The luminescent target of claim 3, wherein the strontium-based luminescent composition comprises from 5% to 50% of the luminescent material.

5. The luminescent target of claim 1, wherein the target is shaped as a three-dimensional block.

6. The luminescent target of claim 1, wherein the target is shaped as a game animal.

7. The luminescent target of claim 1, wherein the target core comprises a polyurethane foam material.

8. The luminescent target of claim 7, wherein the polyurethane foam material has a density of between 2 and 16 pounds per cubic foot.

9. The luminescent target of claim 7, wherein the polyurethane foam material comprises at least one UV stabilizer.

10. The luminescent target of claim 1, wherein the molded sheet formed from luminescent material overlying the target core comprises a luminescent layer applied to at least one side of the core.

11. The luminescent target of claim 10, wherein the molded sheet formed from luminescent material has a thickness of between 1/32" and 6".

12. The luminescent target of claim 1, wherein the core comprises a non-luminescent material.

13. The luminescent target of claim 1, wherein the entire target, including the target core and the molded sheet formed from luminescent material overlying at least a portion of the target core comprises a luminescent glow foam material.

14. A method of manufacturing a luminescent target comprising:

forming target body portion including a cavity; and coupling a molded sheet comprising a luminescent material to the target body portion inside the cavity overlying the target body to form a target that is sufficiently durable to withstand repeated impacts and penetrations by projectiles and is at least partially resilient, wherein the target provides sufficient luminescence for target shooting in low-light conditions and wherein the luminescent material is self-charging by exposure to light.

15. The method of claim 14, wherein the target body portion comprises a polyurethane foam material.

16. The method of claim 14, wherein the molded sheet comprising a luminescent material is permanently attached to the target body portion with a polyurethane-based adhesive.

17. The method of claim 16, wherein the target body portion is non-luminescent.

18. The method of claim 17, wherein the polyurethane foam material comprises a UV stabilizer.

19. An archery target comprising a polyurethane foam base material including a cavity along a first side of the foam base and a mat of strontium-based luminescent material attached in the cavity along the first side of the foam base, whereby the archery target withstands repeated penetration by archery arrows, and whereby the archery target glows sufficiently for target shooting in low light conditions and wherein the strontium-based luminescent material is self-charging by exposure to light.

20. The archery target of claim 19, wherein the polyurethane foam base material is non-luminescent.

21. The archery target of claim 19, wherein the mat of strontium-based luminescent material has a thickness of between 1/32" to 6".

22. The archery target of claim 19, configured as a three-dimensional block.

23. The archery target of claim 19, configured as a model of at least a portion of a game animal.

24. The archery target of claim 19, wherein the polyurethane base material has a density of between 2 to 16 pounds per cubic foot.

25. The archery target of claim 19, wherein the entire target, including the polyurethane foam base material and the mat of strontium-based luminescent material applied to at least one surface of the polyurethane foam base material, comprises a luminescent glow foam material.

* * * * *